United States Patent [19]

Miyares et al.

[11] Patent Number: 4,937,989

[45] Date of Patent: Jul. 3, 1990

[54] LOCKING BRACE FOR UNITING MOBILE HOME SECTIONS THROUGH THEIR UNDERCARRIAGE I-BEAMS

[76] Inventors: Urban Miyares, 12875 Calle De Las Rosas, San Diego, Calif. 92129; Clayton M. Chong, 11338 Surco Dr., San Diego, Calif. 92126; Arthur Angelo, 18331 Verano Pl., San Diego, Calif. 92128

[21] Appl. No.: 335,577

[22] Filed: Apr. 10, 1989

[51] Int. Cl.[5] ..... B66F 7/26

[52] U.S. Cl. ..... 52/126.7; 52/126.6; 52/299; 254/98; 254/43; 182/182; 182/183; 248/287; 248/351

[58] Field of Search ..... 52/DIG. 11, 126.6, 299, 52/365, 125.6, 127.2, 23, 40, 126.7; 254/98, 43, 45, 100; 182/182, 183; 248/287, 351

[56] References Cited

U.S. PATENT DOCUMENTS

| | | | |
|---|---|---|---|
| 2,246,099 | 6/1941 | Kanai | 254/43 |
| 2,458,312 | 1/1949 | Stephen | 254/98 X |
| 3,074,693 | 1/1963 | Shumake | 254/98 X |
| 3,222,030 | 12/1965 | Thorpe | 254/100 |
| 3,493,209 | 2/1970 | Brammer | 254/98 X |
| 3,828,491 | 8/1974 | Koon et al. | 52/DIG. 11 |
| 3,830,024 | 8/1974 | Warnke | 52/DIG. 11 X |
| 3,830,457 | 8/1974 | Stewart | 52/DIG. 11 X |
| 4,014,517 | 3/1977 | Keagle | 52/23 X |
| 4,371,057 | 2/1983 | Blier | 182/183 X |
| 4,404,780 | 9/1983 | Josephson | 254/98 X |
| 4,407,103 | 10/1983 | Miller | 52/23 X |
| 4,417,426 | 11/1983 | Meng | 52/299 X |

*Primary Examiner*—David A. Scherbel
*Assistant Examiner*—Jerrold D. Johnson
*Attorney, Agent, or Firm*—L. Arnold Thaxton

[57] ABSTRACT

A support system, which has support/brace units, for restraining the several mobile sections through their undercarriage I-beams of a mobile or manufactured home, against lateral movement during ground movement, tremors or vibrations. The support system includes a plurality or series of support/brace units, wherein each support unit comprises a pair of vertically adjustable piers clampingly interconnected to a horizontal tie-rod at the junction of two parallel and adjacent I-beams from separate mobile sections. In an alternative embodiment, a single tie-rod may unite two piers at their collars while the piers vertically support adjacently parallel I-beams.

5 Claims, 4 Drawing Sheets

LOCKING BRACE FOR UNITING MOBILE HOME SECTIONS THROUGH THEIR UNDERCARRIAGE I-BEAMS

BACKGROUND OF THE INVENTION

This invention generally relates to a system for supporting buildings above ground surface, and is particularly directed to restraining the lateral movement of undergirders and building sections of mobile homes. The present support or brace system is so designed as to effectively eliminate the consideration of ground tremors and contour, as such conditions may adversely affect the integrity and stabilization of the mobile home.

Mobile homes or house trailers are typically erected off site of the home's setup location, on an undercarriage that consists of I-beams extending the length of the unit. Triangular shaped braces are usually installed perpendicular to the I-beams and adjacent to the underfloor of the mobile home. Once erected at the factory, these units and/or sectons are transported to the site location and then joined to make one, complete mobile home. The mobile home sections are often composed of a single, double, or quad-wide home when the erected sections are joined or fastened together. Experience has taught that the weakest structural points of the joined mobile unit is at the union where the separate sections are joined together.

In order to attain an adequate support for these mobile homes, jacks or piers serve to facilitate leveling of the mobile home. Seismic tremors and/or ground movement occasionally affect the lateral movement of one I-beam relative to another, and, thus, the lateral movement of one sectional unit to another. Such lateral shifts among the I-beams can cause the I-beams to slide off the supporting piers and may also cause separation of the mobile home's several sections. Historically, vibrations resulting in the lateral shifting of I-beams have caused these beams to fall off their piers effecting possible injury to the home's occupants, and/or destruction of content property, and/or structural damage to the mobile home itself.

It is, therefore, the general object of this invention to provide a support and bracing system for the undercarriage of a mobile home that can be expediently installed.

Another object of the invention is to provide an adjustable tie-rod assembly between I-beams or piers attached to I-beams that support the undercarriage and join two sections of a mobile home together. Such a tie-rod assembly eliminates the structural weakness attendant to joining two or more sections of a mobile home together.

A further object of the invention is the provision of a device that will preclude lateral movement of the undercarriage I-beams by bracing such beams, one against the other.

An additional object of the invention is to provide a device that may be quickly and expediently installed on substantially any size mobile home.

Still another object of the invention is to provide a support assembly that is sturdy and durable in construction, efficient and reliable in function, and inexpensive to manufacture and use.

Other objects and advantages of this invention reside in the combination of elements, arrangement of parts, and features of construction, which will become more fully apparent as this description proceeds.

SUMMARY OF THE INVENTION

Accordingly, the present invention has been developed with a view toward implementing a support and bracing system for the undercarriage I-beams and the secure integration of plural sections for a mobile home. The present invention enables both skilled and semi-skilled workers to vertically secure, render level, and transversely brace and support the undercarriage I-beams of a mobile home. Such an inventive support and bracing system constrains the I-beams from lateral and unparalled movement and, thus, shifting off their piers in the event of seismic disturbances, ground or dwelling vibrations, severe winds, or the impact of objects striking the mobile home.

To this end, the present invention provides a mobile home/undercarriage support and bracing system having a series of support units which are principally identical, are relatively light in weight, and portable. The support/brace units are sufficiently strong enough whereby a series of the same units, properly positioned throughout the undercarriage structure, can be adjustably engaged to brace and support the I-beams of various size and length home sections. Such a system of support and bracing units, simultaneous to bracing adjacent I-beams, also achieves the firm abutment of mobile home sections, on-to the other, producing a unitized effect to the entire mobile home assemblage. In essence, the I-beams are supportedly raised or lowered on different sized piers that are adjustable by means of the helix-nut extension of the piers, while adjustably transverse tie-rods clampingly bridge any two adjacent I-beams of one or more mobile home sections, securing the I-beams and sections from lateral movement. In this type of series arrangement, it is preferred that the tie-rod be positioned between parallel and adjacent I-beams that are also supported by piers immediately beneath each I-beam and at or near the pier therebeneath.

The alternative embodiment entails a mobile home undercarriage support wherein the tie-rod is threadedly secured into the sleeve or collar of two identically designed piers. Such married piers are positioned directly beneath two adjacent and parallel I-beams while each pier is clampingly engaged to the bottom of its respective I-beam. A series of this type of support/brace unit can also be arranged in its entirety throughout the mobile home undercarriage or intermingled, as resources permit, with separate tie-rods and piers discussed above.

The foregoing discourse having set forth the broad aspects of the instant inventive concept, a better understanding will be enabled when the following written description is read in conjunction wit appended drawings in which.

DETAILED DESCRIPTION OF THE INVENTION

Figure 1:
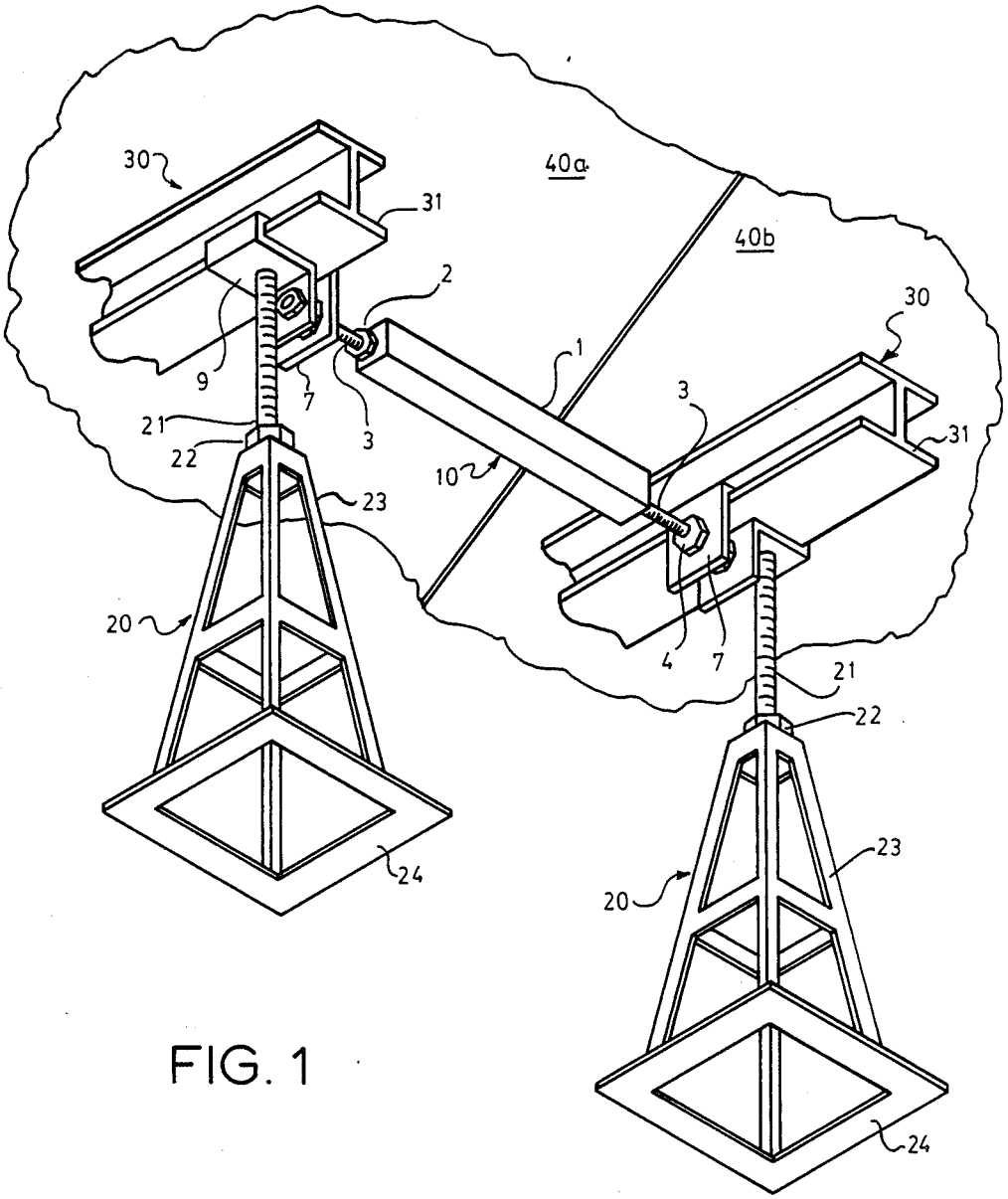
FIG. 1 is a perspective view with a portion of two mobile home floor sections broken away and supported by an I-beam from each section, each I-beam resting upon a pier, and both I-beams are bridged with a tie-rod assembly.

Referring now to the drawings, wherein like numerals refer to like parts throughout the several views. The numerals 10, 20, 30, 40*a* and 40*b* refer generally to tie-rod, piers, I-beams and two sectional mobile home underfloors respectively.

Figure 3:
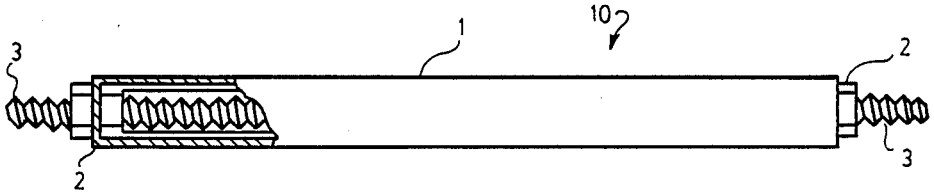
FIG. 3 is a side elevation of the tie-rod lateral support having a cut away section, showing a tubular sleeve with a nut held threaded rod at each end of the sleeve.

As seen in FIG. 1, wherein a complete individual support unit discloses an important aspect of this invention, two sections of a mobile home, as indicated at 40*a* and 40*b* in bottom plan view, are abuttingly united through their adjacent I-beams 30 and tie-rod 10. The support unit consists of a tie-rod assembly 10, with which the present invention is particularly concerned, and two identical piers 20. Tie-rod 10 consists of two identical and threadedly adjustable rods 3, secured to a rectangularly long and axially square sleeve 1 by means of affixed hex nut 2. Hex nut 2 is sufficiently long enough such that a portion of nut 2 is held within the base of sleeve 1 while a smaller portion of nut 2 extends outside the sleeve bore at opposing ends as shown in FIG. 3.

Figure 2:
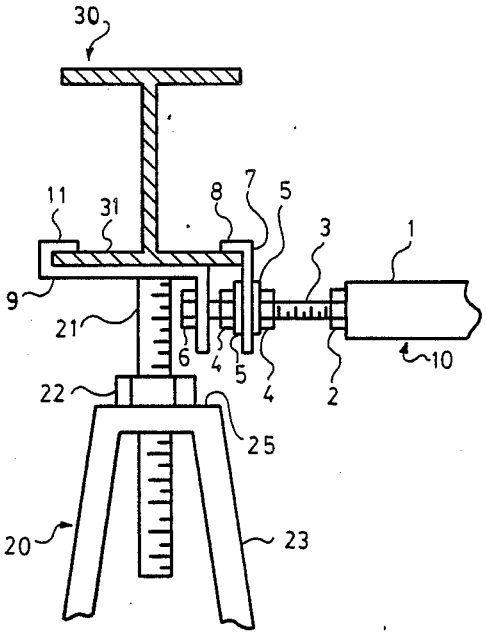
FIG. 2 is a detail and fragmentary vertical view showing the connected relation of the tie-rod, I-beam and pier support of FIG. 1.

Referring to FIG. 2, the tie-rod 10 is fastened to I-beam 30 by an angle bracket 7, containing an aperture that slides over the inner side of rod 3 and fixedly held in selected position by adjusting nuts 4 and washers 5. Bracket 7 further includes a horizontal lip 8 that rests upon one side of bottom flange 31 of I-beam 30. Angle bracket 9 contains a slot 11, that matingly engages bottom flange 31 on its second side and directly opposite to the engagement of bracket 7 thereon. Bracket 9 is adjustably secured to tie-rod 10 at rod 3 by means of hex nut 6. Brackets 7 and 9 comprise a two part clamping mechanism that facilitates the horizontal union of the tie-rod assembly directly to the I-beams, in alignment with the vertical engagement of the piers to the same I-beams. Bracket 7 is of L-shape design while bracket 9 is generally S-shape in configuration, and both brackets are commensurate to each other in engaging flange 31 of any given I-beam undercarriage.

The above and precise arrangement provides for a rigid lateral support against movement of parallel I-beams 30 and mobile home sections 40*a* and 40*b*, on the occasion of ground tremors as well as other disruptive forces.

As can be viewed in FIGS. 1 and 2, I-beams 30 may be secured in a level position and vertically supported through the use of piers 20. Pier 20 is comprised of a base 24 which is square in shape and from which, while extending upwardly into an apex, four stanchions 23 of identical measure in every respect, are bottomly attached to base 24. A horizontal pad 25 is provided at the top convergence of stanchions 23 to both anchor stanchions 23 and provide a rest for a non-rotatable hex nut 22. Supported within hex nut 22 is an adjusting screw 21 that is engagedly threaded at its top end into angle bracket 9. Screw 21 is threadedly and intermediately situated within hex nut 22, while being attached to bracket 9, for the purpose of leveling and vertically securing I-beams 30, and certainly the mobile dwelling itself, above ground.

Figure 4:
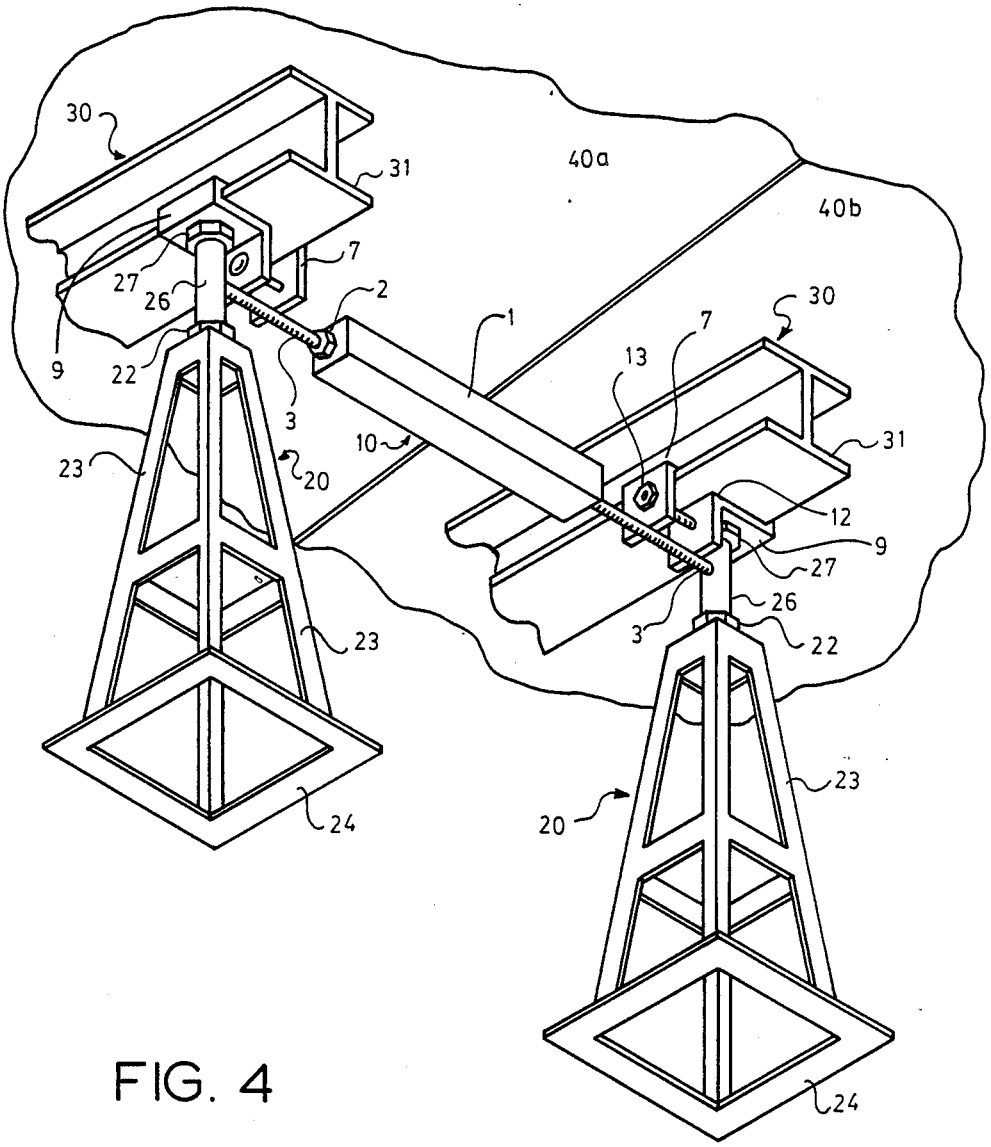
FIG. 4 is an alternative embodiment of the present invention illustrating a perspective view with a portion of two mobile home floor sections broken away and supported by an I-beam from each section, each I-beam resting upon a pier, and both I-beams connected at its sleeve by a tie-rod.

Viewing FIG. 4, an alternative embodiment in the use of tie-rod 10 and pier 20 is disclosed for a mobile home undercarriage support system. For the purpose of describing this structural arrangement, there is seen a support/brace unit of slightly different construction, but a unit that incorporates all of the elements and purposes hereof as previously described in detail, and having a difference primarily residing in tie-rod 10 being threadedly engaged into a pier collar 26.

Tie-rod 10 is threadedly attached, at each end, to a pier collar 26 by means of the threadedly adjustable rods 3. At its top end, collar 26 is disposed with a jam nut 27 constructed to hold adjusting screw 21 in locked engagement within bracket 9. At its bottom end, collar 26 is disposed with a non-rotatable hex nut 22 wherein hex nut 22 is welded to the pier pad 25 and functions to centrally secure screw 21 to the pier body.

Figure 5:
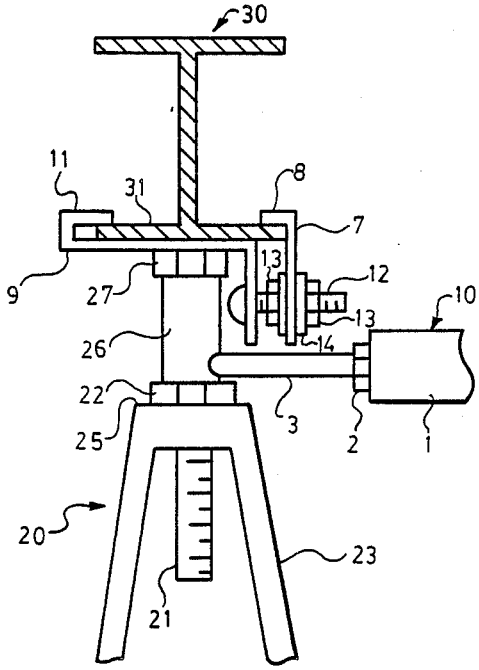
FIG. 5 is a detail and fragmentary vertical view showing the connected relation of the tie-rod, pier sleeve and I-beam of FIG. 4.

As illustratively set forth in greater detail in FIG. 5, I-beam 30 is clampingly engaged at a first side of bottom flange 31 by the horizontal lip 8 of bracket 7. Angle bracket 9, containing a slot 11, matingly engages slot 11 onto flange 31 at its second side and directly opposite to the disposition of bracket 7. L-shape bracket 7 and S-shape bracket 9 securely fasten onto I-beam 30 by means of lag bolt 12, nuts 13 and washers 14.

Figure 6:
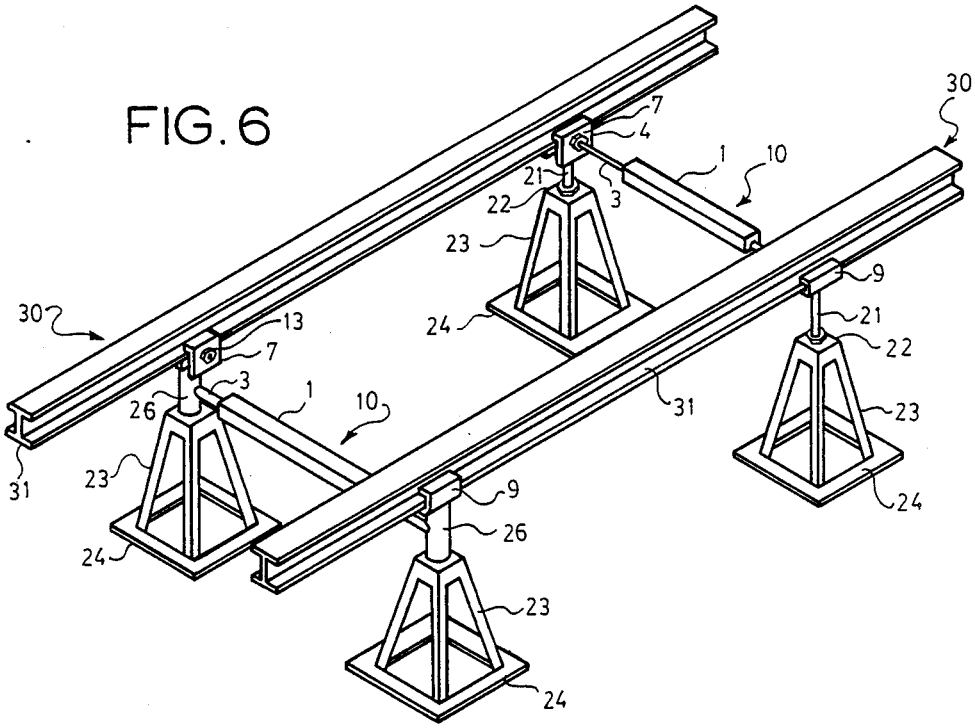
FIG. 6 is a somewhat diagrammatic view to illustrate a preferred arrangement of a series of support/brace units and the lateral interconnection thereof.

The placement of tie-rods 10 between I-beams 30 and the interconnection of the piers 20 with I-beams and tie-rods is shown in FIG. 6, albeit, on a relatively small scale. One skilled in the art, however, can readily appreciate that a plurality of the inventive support units may be used in series or alternated throughout the undercarriage I-beams. It can further be appreciated that support units of FIGS. 1 and 4 may be employed either in series, as the same units, or alternated among themselves, one different unit after the other, all units achieving the purpose of preventing the lateral separation of mobile home sections as well as the lateral movement of I-beams.

It is apparent that the new and improved inventive mobile home support system, described herein, is capable of being readily assembled or disassembled into its individual components. Moreover, it is contemplated that production of the inventive support system embraces the use of easily portable materials that are light weight but strong and sturdy. The elements of the invention may be made of steel, iron or other such formidable material within the purview of technology already available.

It will, of course, be understood that modifications of the present invention in its various aspects will be apparent to those skilled in the art, some being apparent only after study while others being a matter of routine design. In light of the foregoing discussion it can be seen that herein provided is a new and improved support system, fundamentally comprised of a support/brace, for a mobile home that gives recourse in overcoming disengagement of mobile home sections and the lateral movement of undercarriage I-beams. The invention, therefore, should not be seen as rigidly confined to the particular construction and arrangement of parts herein illustrated and described, but embraces all such modified forms thereof as come within the scope of the appended claims.

We claim:

1. A support unit for restraining the lateral movement of abutted mobile home sections and two undercarriage I-beams of a mobile home, wherein the support unit comprises a pair of vertically adjustable and identical piers, each said pier being adapted to seat beneath a single I-beam, wherein each of said piers has a square base, stanchions extending upwardly therefrom, a horizontal pad attached to the upper end of each of said stanchions, wherein said pad has a non-rotatable hex nut that supports a threaded rod, and a two part clamp disposed at the top of said rod to engage a bottom flange of the I-beam thereabove, said support unit being further defined by a tie-rod assembly having adjustably threaded rods disposed at opposite ends thereof, and said tie-rod assembly being transversely situated between adjacent I-beams while in alignment with said piers therebeneath, said tie-rod assembly being secured to each said two I-beams by engaging said two part clamp with each of the threaded rods of said tie-rod assembly.

2. The support unit of claim 1, wherein the tie-rod is transversely secured to two adjacent and parallel I-beams by means of a two part clamp that includes a slotted S-shaped bracket comprising a vertical section which contains an unthreaded aperture therein and a horizontal base section which contains a threaded aperture therein, and a L-shaped bracket having a vertical portion which contains an unthreaded aperture, and wherein both of said unthreaded apertures receive either of said adjustably threaded rods of said tie-rod assembly and said adjustably threaded rods are secured to said two part clamp by washers and hex nuts.

3. The support unit of claim 2, wherein the tie-rod assembly consists of an axially long sleeve having a portion with a square cross section disposed an affixed hex nut at opposing ends and said hex nuts securely retaining identical and threadedly adjustable rods.

4. A support unit for restraining the lateral movement of abutted mobile home sections and two undercarriage I-beams of a mobile home, wherein the support unit comprises a pair of vertically adjustable and identical piers, each said pier being adapted to seat beneath a single I-beam wherein each of said piers has a square base, stanchions extending upwards therefrom, a horizontal pad attached to the upper end of said stanchions, wherein said pad has a non-rotatable hex nut affixed thereon that supports a threaded rod, a cylindrical collar containing an intermediately situated threaded aperture and a hex nut disposed atop said collar, and a two part clamp directly above and engaging the bottom portion of said I-beam thereabove, said support unit being further defined by a tie-rod assembly having adjustably threaded rods disposed at opposite ends thereof, and said tie-rod being transversely positioned between adjacent I-beams while being connected at the threaded aperture of each said pier collar.

5. The support unit of claim 4, wherein the tie-rod assembly consists of an axially long sleeve having a portion with a square cross section disposed with affixed hex nuts at opposing ends and said hex nuts securely retaining identical and threadedly adjustable rods.

* * * * *